US005325158A

United States Patent [19]

Guelfo et al.

[11] Patent Number: 5,325,158

[45] Date of Patent: Jun. 28, 1994

[54] VENTILATION AND COOLING DEVICE FOR A PHOTOCOPIER

[75] Inventors: Roberto Guelfo, Castellamonte; Renato Bortolin, Montanaro, both of Italy

[73] Assignee: Olivetti-Canon Industriale S.p.A., Torino, Italy

[21] Appl. No.: 14,493

[22] Filed: Feb. 8, 1993

[30] Foreign Application Priority Data

Feb. 17, 1992 [IT] Italy ..... T092 A 000121

[51] Int. Cl.[5] ..... G03G 21/00

[52] U.S. Cl. ..... 355/215; 355/30

[58] Field of Search ..... 355/215, 30, 200, 282, 355/285, 289, 290

[56] References Cited

U.S. PATENT DOCUMENTS

| | | | |
|---|---|---|---|
| 4,571,056 | 2/1986 | Tani et al. | 355/290 |
| 4,693,588 | 9/1987 | Yarbrough et al. | 355/282 |
| 5,038,170 | 8/1991 | Serita | 355/200 |
| 5,155,531 | 10/1992 | Kurotori et al. | 355/215 |

FOREIGN PATENT DOCUMENTS

| | | | |
|---|---|---|---|
| 0035147 | 4/1981 | Japan | 355/215 |
| 0017957 | 1/1982 | Japan | 355/215 |
| 0197580 | 12/1982 | Japan | 355/282 |
| 0174867 | 10/1984 | Japan | 355/282 |
| 0135959 | 7/1985 | Japan | 355/215 |
| 0296166 | 12/1987 | Japan | 355/215 |
| 0128073 | 5/1989 | Japan | 355/282 |
| 0183275 | 7/1990 | Japan | 355/282 |

*Primary Examiner*—A. T. Grimley
*Assistant Examiner*—Robert Beatty
*Attorney, Agent, or Firm*—Banner, Birch, McKie & Beckett

[57] ABSTRACT

A ventilation device for a photocopier draws ozone mixed air from a developing unit and image transfer unit and forwards it to ventilate a fusion unit where the subsequent heating of the air reduces the ozone content. The air flow evacuates the condensed water issued by the sheets of paper during the fixing.

8 Claims, 3 Drawing Sheets

VENTILATION AND COOLING DEVICE FOR A PHOTOCOPIER

FIELD OF THE INVENTION

The present invention refers to a ventilation and cooling device suitable for use in a photocopier.

BACKGROUND OF THE INVENTION

Electrically powered photocopiers, laser printers and the like contain operating units and/or elements which work at high temperatures, which causes them to heat the photocopier during operation. Such units/elements include the fusion unit, lighting bulbs, motors, transformers, etc., which generate a quantity of heat which needs to be evacuated.

Moreover, the photocopier generally comprises at least two corona effect devices, one of which charges the photoconductor with electrostatic charges of appropriate polarity before the image is printed and the other of which discharges residual charges after cleaning of the photoconductor. The transfer of the developed image may also be performed by a corona device.

During their operation, these corona devices generate a certain quantity of ozone, which must be evacuated and/or reduced both for ecological reasons and because it can damage the photoconductor. To accomplish this photocopiers employ air flows actuated by suitable ventilators situated in different parts of the photocopier to individually ventilate the various units and/or elements generating heat and ozone. Each of these air flows issues from the photocopier by its own separate route.

This scattered configuration of ventilators and their relative air routes renders machines very bulky and costly.

SUMMARY OF THE INVENTION

Preferred embodiments of the present invention is to provide a ventilation and cooling device for a photocopier which is simple in structure, and which operates to evacuate heat from the hot zones and to efficiently remove and reduce the ozone inside the machine.

The invention is defined in the appended claims to which reference should now be made.

BRIEF DESCRIPTION OF THE DRAWINGS

A preferred embodiment of the invention will now be described in detail, by way of example with reference to the accompanying drawings, in which.

DETAILED DESCRIPTION OF THE INVENTION

Figure 1:
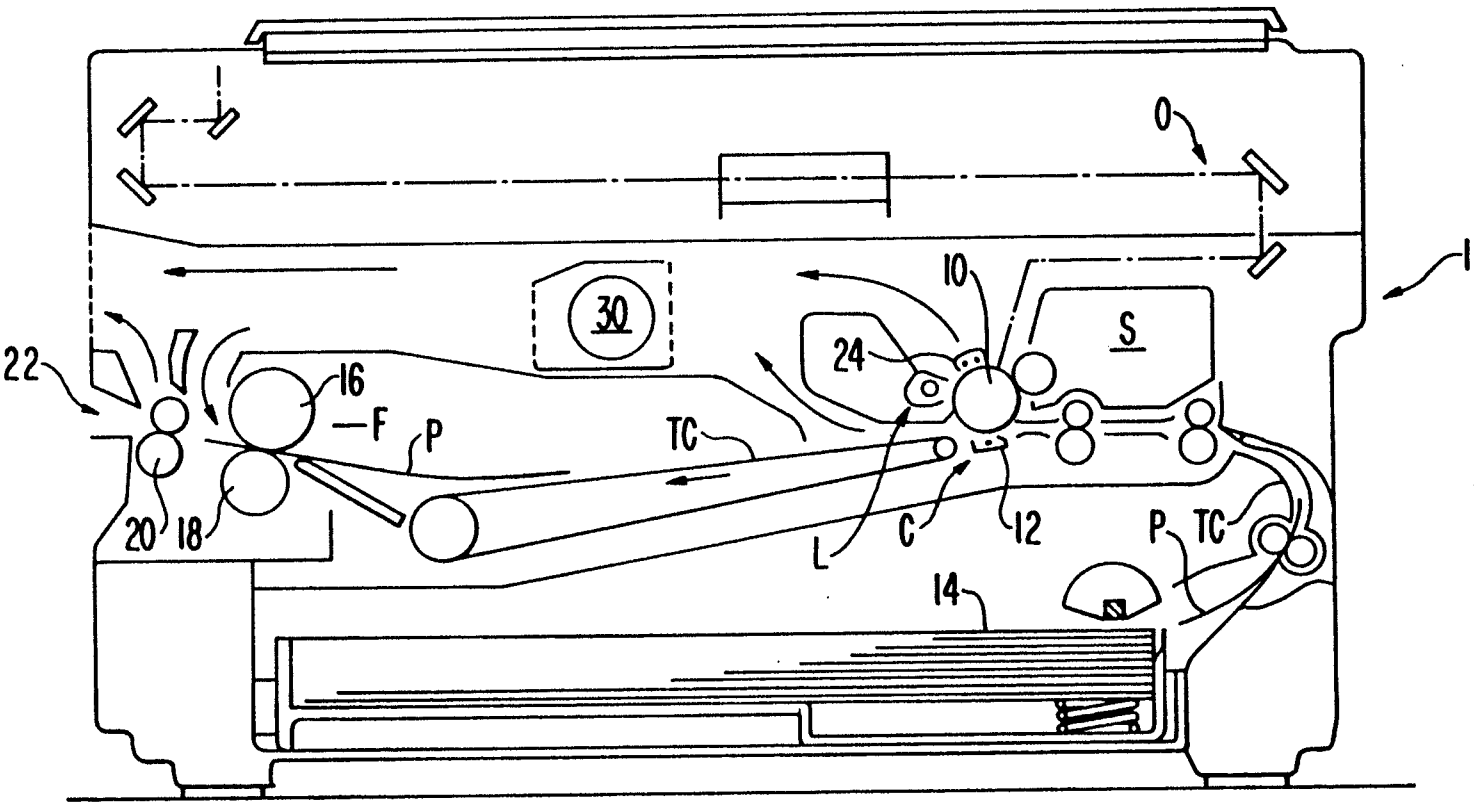
FIG. 1 shows the interior of a photocopier using a ventilation and cooling device embodying the invention.

Referring now to FIG. 1, a photocopier 1 essentially comprises a developing unit S, a paper conveyor system TC and a unit F for thermally fixing or fusing the developed image on a sheet of paper P.

The developing unit S, which is of a conventional type, develops the latent image on the photoconducting coating of a drum 10. The image is formed on a drum by an optical system O. The drum 10, rotating, for example, in clockwise direction, transports the thus developed image opposite a transfer device C which uses a charging device 12 operating with corona effect to transfer the image to the sheet of paper P.

The sheet of paper P has been previously collected from a box 14 and forwarded to the developing unit by the conveyor system TC.

The sheet of paper P bearing the developed image is forwarded by the conveyor system TC to unit F to fix the image indelibly to the sheet P.

The fixing unit F, or primary operating unit, comprises a pair of rollers 16 and 18. The top roller 16 is heated by a known means and pressed against the bottom roller 18. The sheet P passes between the two rollers 16 and 18, which fix the developed image by thermal effect and pressure.

The sheet P is then discharged from the machine by rollers 20 via a slit 22.

A second corona device 24 is provided against the drum 10. The said device 24 operates to remove the residual electrostatic charges from the drum 10. The device 24 is also used selectively to charge the photoconductor before the optical printing.

As has been noted, the two charging devices 12 and 24, or secondary operating unit, operate by corona effect and generate a certain quantity of ozone. If the ozone is not quickly eliminated, it can chemically attack the photoconducting coating on drum 10, react with certain components of the toner powder used to develop the images, and also damage parts of the delicate components of the electronic circuits inside the photocopier.

Ozone is a thermolabile gas which can be almost totally decomposed at a temperature of around 200° C.

In this embodiment of the present invention, a single ventilator, or fan 30 is used to draw the ozone-mixed air from the developing unit S, and the transfer device C, and from convey it outside the machine.

The other parts of the photocopier illustrated in FIG. 1 are not described in detail as they have no bearing on the present invention.

Figure 2:
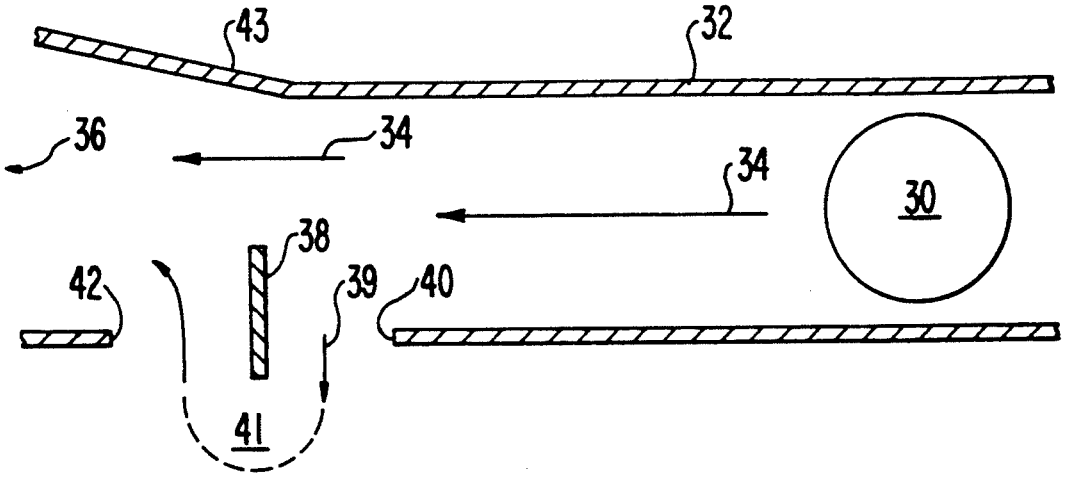
FIG. 2 is a simplified representation of the air flow configuration in an embodiment of the invention.

We refer now to FIG. 2, which shows a basic representation of a ventilation and cooling device embodying the invention. A single conduit 32 for conveying an air flow 34 is disposed between the ventilator 30 and an outlet window 36.

Wall deflecting means 38, 48 include a deflecting wall 38, inserted in the conduit 32 to divert a branch flow 39 from the main flow 34 via a primary aperture 40 to directly ventilate a photocopier zone 41 outside the conduit 32. Zone 41, represents, for example, the chamber containing the fusion unit, which will be described below.

The branch flow 39 is conveyed through a secondary aperture 42 and fed back into the main flow 34 downstream from wall 38 owing to a reduction in pressure created by the wall 38 and by the effect of the diverging form of the end walls 43 of the conduit 32.

Figure 3:
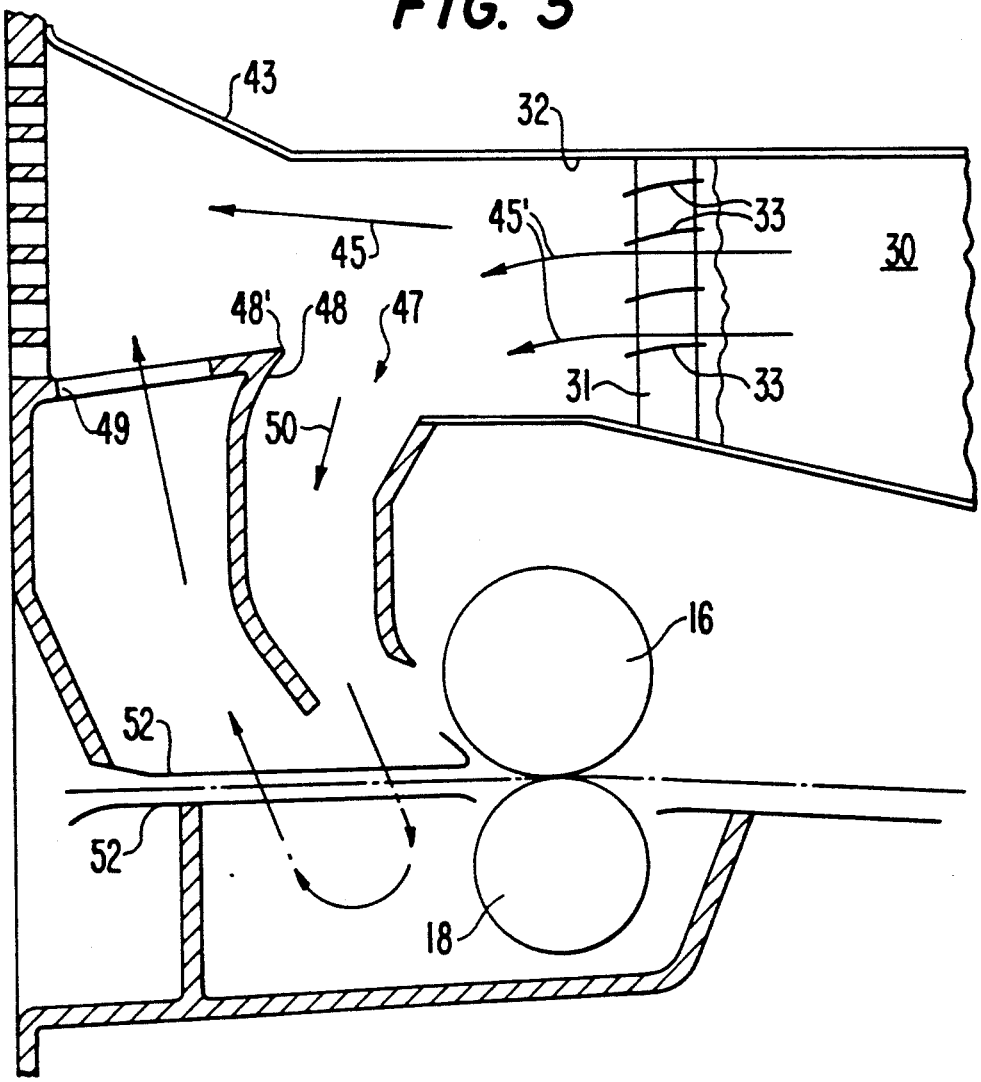
FIG. 3 is an enlarged schematic representation of a ventilated zone in FIG. 1.

FIG. 3 shows a typical application of the invention process to the fusion unit of a photocopier.

An air flow 45 from the developing unit not shown in FIG. 3 is forced by a ventilator 30 and partially deflected through a primary aperture 47 in conduit 32 by means of a deflecting wall 48 protruding inside the conduit 32. The flow 45 contains a certain quantity of ozone evacuated from the corona devices 12 and 24 shown in FIG. 1. The deflected part 50 of the flow encounters rollers 16 and 18 which are at high temperature. In particular, roller 16 is maintained at a temperature of between 190° C. and 200° C. The heat evacuated from the rollers 16 and 18 heats the ozone contained in the branch flow 50, which is transformed in the form of oxygen. The branch flow 50 is then drawn into conduit 32 through an aperture 49 situated downstream from wall 48 by a reduction in pressure created by the wall 48 and due to the divergent form of the wall 43 of conduit 32 downstream from wall 48.

The corner 48' of wall 48 projects inside conduit 32 to restrict the section of conduit 32 by a value of between 20% and 50%, inclusive, of the said section.

The reduction in pressure formed downstream from the corner 48' in air flow direction is of the order of a 10–50 mm water column in relation to the flow pressure 45 corresponding to the primary aperture 47.

Moreover, the branch flow 50 evacuates the steam released by the paper, which would cause deposits of condensed water on the metal and/or plastic parts 52 on the paper route downstream from the fusion rollers 16 and 18, particularly at the start of the photocopier activity, when its internal structure has not yet attained operating temperature.

Figure 4:
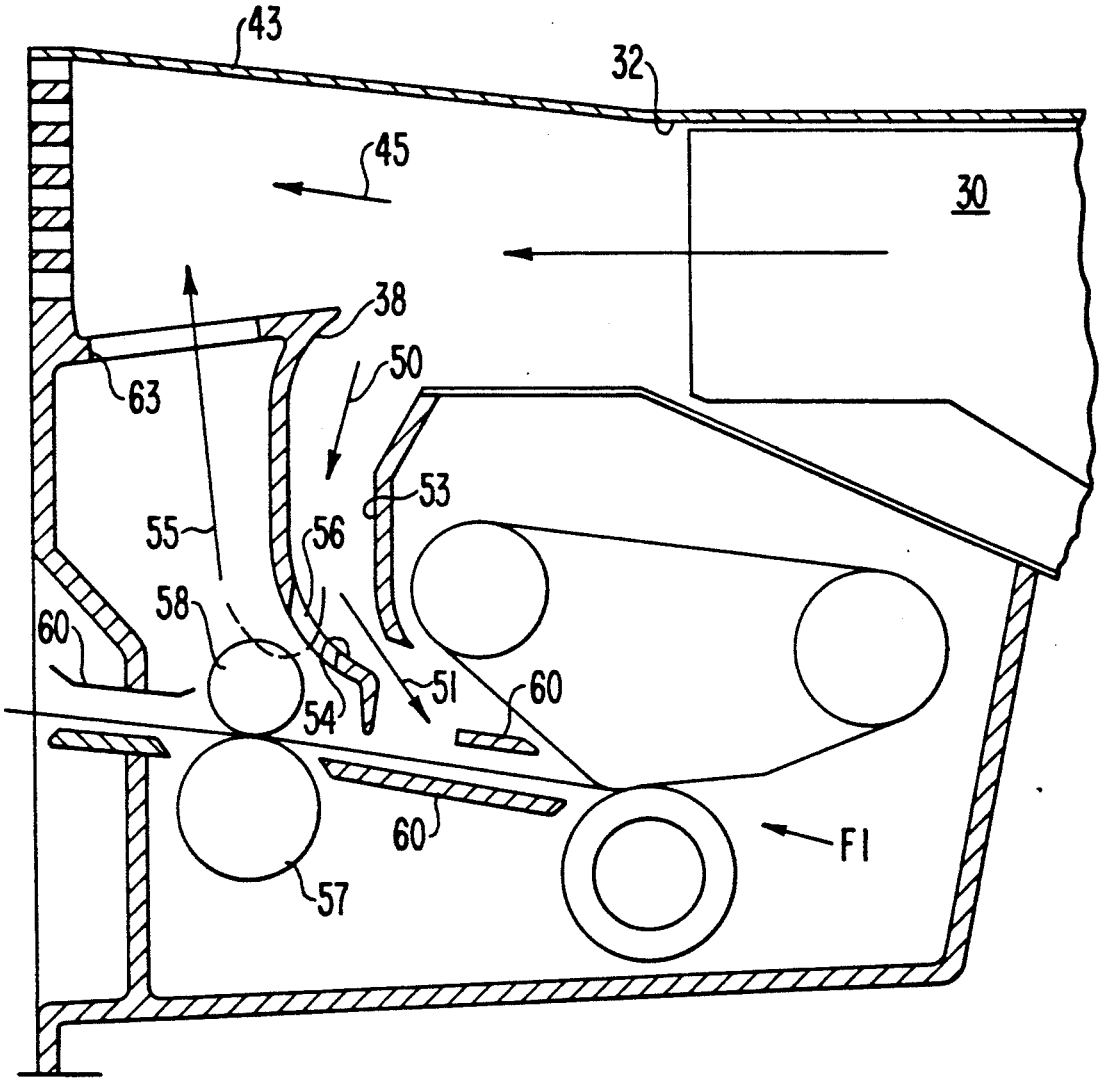
FIG. 4 shows a different form of embodiment of the zone in FIG. 3.

FIG. 4 illustrates the application of the ventilation and cooling device embodying the invention to a belt-driven fusion unit F1, for example, of the type described in Italian application No. TO91A000832 of Nov. 5, 1991 filed by the applicant.

The branch flow 50 is subsequently subdivided into a primary flow 51 which is fed towards the fusion unit F1 by the wall curves 53 and 54 and a secondary flow 55 which, via an aperture 56) in wall 54), contacts the two rollers 57) and 58) which eject the sheets. After having cooled the fusion unit F1) and ventilated rollers 57), 580 and the paper guides 60), respectively, the two flows 51) and 55) are conveyed through an aperture 63) situated downstream from the deflector wall 38) and are ejected from the machine along with the remaining part of the main flow 45).

It goes without saying that modifications, additions and replacements of parts may be made to the ventilation and cooling device for a photocopier without, however, affecting the scope of the present invention. For example, the outlet orifice 31 FIG. 3 of ventilator 30 is provided with an array of vanes 33 tilted downwards to direct the air flow 45' prevalently towards aperture 47, thus deviating the flow 50.

We claim:

1. A ventilation and cooling device for a photocopier having primary operating units which generate heat and secondary operating units which generate thermolabile gases, comprising:

a conduit disposed between said primary and secondary operating units;

a window connecting said conduit to an area outside the photocopier;

means for ventilating said primary and secondary operating units by generating an air flow along said conduit;

a primary aperture in said conduit;

a secondary aperture in said conduit;

a wall deflecting means disposed between said primary and secondary apertures wherein said wall deflecting means deflects a part of said air flow containing said thermolabile gases through said primary aperture to contact said primary operating units and then through said secondary aperture and into said conduit, whereby traces of humidity are evacuated and said thermolabile gases are transformed by heat evacuated from said primary units.

2. A ventilation and cooling device according to claim 1, wherein said wall deflecting means comprise a wall projecting inside said conduit to intercept said part of said air flow and to create a reduction in pressure in relation to said secondary aperture.

3. A ventilation and cooling device according to claim 2, wherein said wall restricts a cross-section of said conduit by 20% to 50%.

4. A ventilation and cooling device according to claim 1, wherein said ventilating means comprise a ventilator disposed in said conduit between said secondary units and said primary units said ventilating means comprises means for directing air flow towards the primary aperture.

5. A ventilation and cooling device according to claim 4, wherein said directing means comprise an array of vanes tilted towards said primary aperture, whereby said ventilator and said vanes cause an increased flow of air towards said primary aperture.

6. A ventilation and cooling device according to claim 1, wherein said conduit comprises walls which diverge towards said window, to generate a reduction in pressure in relation to said secondary aperture.

7. A ventilation and cooling device according to claim 6, wherein said reduction in pressure differs by 10–50 mm of water column from the pressure existing in relation to said primary aperture.

8. A method for ventilating and cooling a heat generating unit in a photocopier, in which an air flow path is defined between a thermolabile gas generating unit and said heat generating unit, the method comprising the steps of:

a) conveying said flow of air containing said thermolabile gas past said thermolabile gas generating unit, by air flow impelling means disposed in said path;

b) directing a part of said flow of air against a wall deflecting means disposed into said path, adjacent said heat generating unit, to deflect said air flow part towards said heat generating unit;

c) creating a reduction in pressure beyond said heat generating unit and downstream of said wall deflecting means;

d) drawing up said air flow part from said heat generating unit towards the outside of said photocopier through an aperture disposed downstream said wall deflecting means, where said reduction in pressure is created and mixing said air flow part with a remaining part of said flow of air, past said deflecting means.

* * * * *